US006419542B1

(12) United States Patent
Liu

(10) Patent No.: US 6,419,542 B1
(45) Date of Patent: Jul. 16, 2002

(54) THREE-DIMENSIONAL TOY BUILT UP WITH FREELY CONNECTABLE PARTS

(76) Inventor: Kuo-Ching Liu, 5Fl, No. 11, Alley 1, Lane 1, Sec. 1, Yunhan S. Rd., Lujou City, Taipei (TW), 247

( * ) Notice: Subject to any disclaimer, the term of this patent is extended or adjusted under 35 U.S.C. 154(b) by 0 days.

(21) Appl. No.: 09/951,423

(22) Filed: Sep. 14, 2001

(51) Int. Cl.[7] ..... A63H 3/16
(52) U.S. Cl. ..... 446/97; 446/387
(58) Field of Search ..... 446/97, 98, 99, 446/100, 101, 308, 309, 321, 385, 387

(56) References Cited

U.S. PATENT DOCUMENTS 3,753,312 A * 8/1973 Hughes, Jr. ..... 428/16
4,118,887 A * 10/1978 Appleman ..... 446/124
6,179,681 B1 * 1/2001 Matos ..... 446/101

* cited by examiner

*Primary Examiner*—Jacob K. Ackun
(74) *Attorney, Agent, or Firm*—Troxell Law Office PLLC

(57) ABSTRACT

A three-dimensional toy includes a toy sportsman and a toy ball built up by connecting a plurality of flat parts to one another through engagement of slits, notches and recesses formed on the flat parts. The parts forming the toy sportsman include a main body showing head and trunk of the sportsman, and bent hands and legs detachably connected to the main body. The parts forming the toy ball include two flat round parts intersect with each other. A flat part serving as a supporting base is connected to one of the leg parts and has a connecting base detachably connected to a free end thereof. The toy ball is also detachably connected to an end of the connecting base. A player may employ his or her imagination to freely build up the toy sportsman with these flat parts, so that the sportsman shows different postures of playing ball.

5 Claims, 2 Drawing Sheets

THREE-DIMENSIONAL TOY BUILT UP WITH FREELY CONNECTABLE PARTS

FIELD OF THE INVENTION

The present invention relates to a three-dimensional built-up toy, and more particularly to a three-dimensional toy including a toy sportsman and a toy ball built up with freely connectable parts. A player could freely employ his or her imagination to detachably connect these parts, so that the toy sportsman built up each time shows a different posture of playing ball.

BACKGROUND OF THE INVENTION

A conventional modeling toy usually includes a plurality of connectable parts and a manufacturer's instruction sheet. A player follows the instruction sheet to sequentially assemble the connectable parts into a complete model. Such conventional modeling toy becomes a complete toy having a fixed appearance once it is assembled, and could not be disassembled for re-assembling into another appearance. That is, the conventional modeling toy provides only one opportunity for the player to employ his or her thinking ability to assemble and enjoy the toy. Therefore, it is tried by the inventor to develop a three-dimensional built-up toy that could be repeatedly disassembled and re-assembled by a player to build up a toy showing a different posture each time completely depending on the player's free imagination.

SUMMARY OF THE INVENTION

A primary object of the present invention is to provide a three-dimensional built-up toy that may be repeatedly re-assembled by a player to show a different appearance each time completely depending on the player's free imagination.

To achieve the above and other objects, the three-dimensional toy of the present invention mainly includes a toy sportsman and a toy ball, both of which are built up from a plurality of detachably connected parts.

The parts forming the toy sportsman include a main body showing head and trunk of the sportsman, and bent hands and legs detachably connected to the main body through engagement of slits separately provided on the main body and the hands and the legs at predetermined positions. The parts forming the toy ball include two flat round parts provided with notches, so that the two flat round parts intersect with each other at these notches to form a three-dimensional ball. A flat part serving as a supporting base is connected to one of the leg parts and has a connecting base detachably connected to and outward extended from a free end thereof through engagement of recesses separately provided on the supporting and the connecting bases. The toy ball is also detachably connected to an end of the connecting base through engagement of a notch with a recess on the connecting base.

A player may employ his or her imagination to freely build up the toy sportsman with these flat parts, so that the sportsman built up each time shows a different posture of playing ball.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
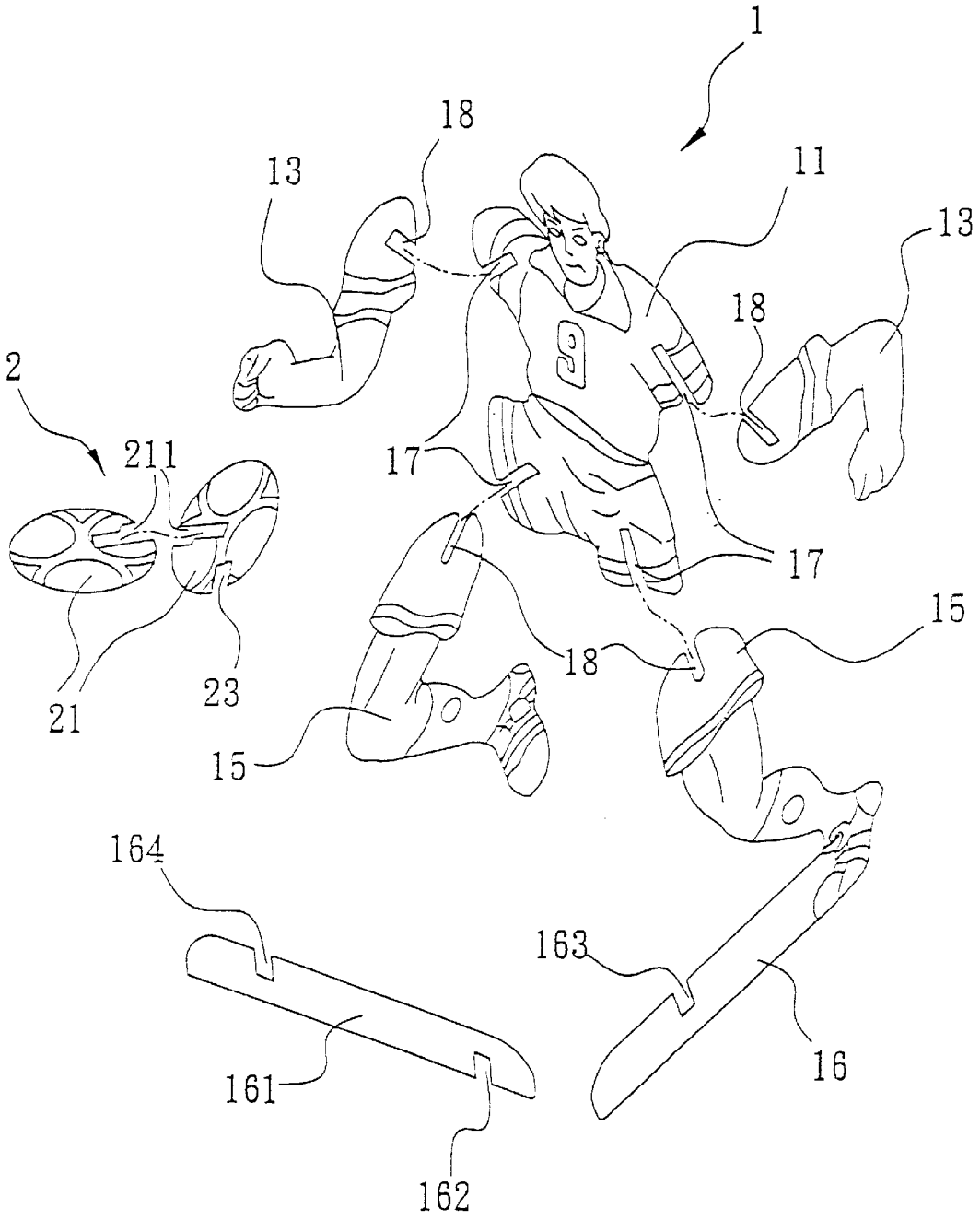
FIG. 1 is an exploded perspective view showing connectable parts for building up a toy according to the present invention.
Figure 2:
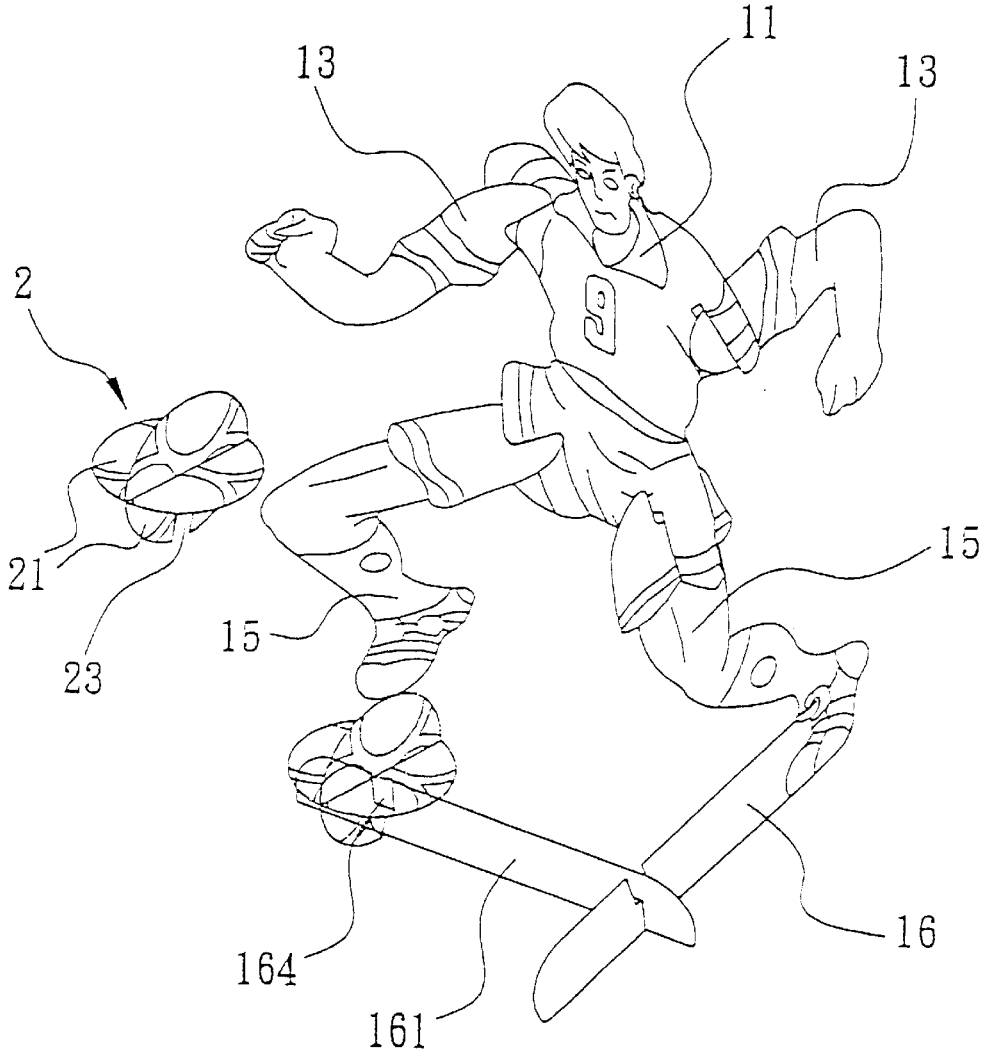
FIG. 2 is an assembled perspective view showing an example of the toy of the present invention that could be built up from the connectable parts of FIG. 1.

Please refer to FIG. 1 that shows a plurality of connectable parts for building up a three-dimensional toy according to the present invention, and to FIG. 2 that shows an example of the toy that could be built up from the connectable parts of FIG. 1.

As shown, the connectable parts of FIG. 1 are designed to build up a toy sportsman 1 and a toy ball 2. The connectable parts for forming the toy sportsman 1 mainly include a flat piece of main body 11 showing head and trunk of the sportsman 1,. a plurality of flat pieces of hands 13, and a plurality of flat pieces of legs 15, one of which has a flat piece of supporting base 16 connected thereto.

The main body 11 is symmetrically provided at two lateral sides of upper and lower portions at predetermined positions with first slits 17 having a predetermined depth. Each of the hands 13 and the legs 15 is also provided with a second slit 18 corresponding to the first slits 17, such that the hands 13 and the legs 15 could be detachably and movably connected to the main body 11 by engaging the second slits 18 with the first slits 17 to form a complete toy sportsman 1. The supporting base 16 is connected at a free end to a connecting base 161, so that the connecting base 161 intersects with the supporting base 16 to extend outward from the free end of the supporting base 16.

The connectable parts for forming the toy ball 2 include two flat round pieces 21 that are detachably and movably connected to intersect with each other. A first notch 23 is provided on at least one of the two flat round pieces 21 for engaging with the connecting base 161.

With the above arrangements, a player may connect the hands 13 and the legs 15 to the main body 11, and the flat round pieces 21 and the connecting base 161 to the supporting base 16 in different manners completely depending on the player's imagination. In the course of building up the toy sportsman 1 and the toy ball 2 with the connectable parts of the present invention, the player is guided to employ his or her thinking ability and imagination for the toy sportsman to show many different postures and positions.

In the present invention, the connectable parts of hands 13 and legs 15 are designed to bend into different angles, so that they could be connected to the main body 11 to build a sportsman 1 showing a lively posture of playing ball. Moreover, the hands 13 and the legs 15 could be freely detached from and re-connected to the main body 11 in different manner, angle or direction to show a different posture of playing ball.

In the present invention, the two round flat pieces 21 for forming the toy ball 2 are respectively provided at one side of their circumferential edges with a second notch 211 having a predetermined depth, so that the two flat round pieces 21 intersect at the second notches 211 to connect into one unit, that is, the toy ball 2.

In the present invention, the connecting base 161 is provided at a first end with a first recess 162 having a predetermined depth, and the supporting base 16 is provided near the free end with a engaging recess 163 having a predetermined depth and corresponding to the first recess 162 of the connecting base 161, so that the connecting base 161 is movably connected to the supporting base 16 by engagement of the first recess 162 with the engaging recess 163.

In the present invention, the connecting base 161 is further provided at a second end with a second recess 164 for engaging with the first notch 23 provided on the toy ball 2, so that the toy ball 2 is movably connected to the connecting base 161 by engagement of the first notch 23 with the second recess 164.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A three-dimensional toy built up with freely connectable parts, comprising:

a flat main-body part showing head and trunk of a sportsman, said main-body part being symmetrically provided at two sides of upper and lower portions with first slits having a predetermined depth;

a plurality of flat hand parts, each of which being provided at an end at a position corresponding to said first slits on said upper portion of said main-body part with a second slit;

a plurality of flat leg parts, each of which being provided at an end at a position corresponding to said first slits on said lower portion of said main-body part with a second slit;

a flat supporting-base part being connected to one of said leg parts, and having a flat connecting-base part connected to a free end of said supporting-base part to intersect with and outward extend from said supporting-base part; and a toy ball including two flat round parts connected to and intersecting with each other, and being provided at a predetermined position with a first notch for engaging with said connecting-base part outward extended from said supporting-base part; and said hand parts and said leg parts being detachably and movably connected to said main-body part through engagement of said second slits with said first slits to build up a complete toy sportsman, and said toy ball being detachably and movably connected at said first notch to said connecting-base part outward extended from said supporting-base part.

2. The three-dimensional toy built up with freely connectable parts as claimed in claim 1, wherein said hand parts and said leg parts are bent into a predetermined angle, such that said toy sportsman built up by connecting said hand parts and said leg parts to said main-body part has a lively posture of playing ball.

3. The three-dimensional toy built up with freely connectable parts as claimed in claim 1, wherein said two flat round parts forming said toy ball are provided at circumferential edges with two second notches having a predetermined depth, and said two flat round parts being connected to and intersecting with each other at said second notches to form said toy ball.

4. The three-dimensional toy built up with freely connectable parts as claimed in claim 1, wherein said connecting-base part is provided at a first end with a first recess having a predetermined depth, and said supporting-base part being provided at said free end with an engaging recess, so that said connecting-base part is connected to and outward extended from said supporting-base part through engagement of said first recess with said engaging recess.

5. The three-dimensional toy built up with freely connectable parts as claimed in claim 1, wherein said connecting-base part is provided at a second end with a second recess, and said toy ball being connected to said connecting-base part through engagement of said first notch with said second recess.

* * * * *